US010053790B2

(12) United States Patent
Hu et al.

(10) Patent No.: US 10,053,790 B2
(45) Date of Patent: Aug. 21, 2018

(54) ELECTRICAL BRUSH PLATING SYSTEM AND METHOD FOR METAL PARTS

(71) Applicants: People's Liberation Army Academy of Armored Forces Engineering, Beijing (CN); Beijing Ronglu Mechanical Product Remanufacturing Technology Limited Company, Beijing (CN)

(72) Inventors: Zhengfeng Hu, Beijing (CN); Binshi Xu, Beijing (CN); Xiaohe Wang, Beijing (CN); Biao Lv, Beijing (CN); XiuBing Liang, Beijing (CN); Peijing Shi, Beijing (CN); Yongxiong Chen, Beijing (CN); Zhihai Cai, Beijing (CN)

(73) Assignees: PEOPLE'S LIBERATION ARMY ACADEMY OF ARMORED FORCES ENGINEERING, Beijing (CN); BEIJING RONGLU MECHANICAL PRODUCT REMANUFACTURING TECHNOLOGY LIMITED COMPANY, Beijing (CN)

( * ) Notice: Subject to any disclaimer, the term of this patent is extended or adjusted under 35 U.S.C. 154(b) by 689 days.

(21) Appl. No.: 14/166,459

(22) Filed: Jan. 28, 2014

(65) Prior Publication Data

US 2014/0251815 A1 Sep. 11, 2014

(30) Foreign Application Priority Data

Mar. 6, 2013 (CN) ..... 2013 1 0071395

(51) Int. Cl.
*C25D 5/06* (2006.01)
*C25D 17/14* (2006.01)
(Continued)

(52) U.S. Cl.
CPC ..... *C25D 5/06* (2013.01); *C25D 3/12* (2013.01); *C25D 17/12* (2013.01); *C25D 17/14* (2013.01); *C25D 21/12* (2013.01)

(58) Field of Classification Search
CPC ... C25D 5/06; C25D 3/12–3/18; C25D 13/14; C25D 17/06; C25D 5/22; C25D 7/04
See application file for complete search history.

(56) References Cited

U.S. PATENT DOCUMENTS 4,634,503 A * 1/1987 Nogavich ..... C25D 5/08 204/237
4,647,345 A * 3/1987 Polan ..... C25D 5/20 204/216

(Continued)

FOREIGN PATENT DOCUMENTS

CN 101514468 B * 11/2010
CN 101748454 B * 3/2011
JP S60-165390 * 8/1985 ..... C25D 7/06

OTHER PUBLICATIONS

Xu and Hu et al., human translation, CN 101748454 B (2011).*
Xu et al., human translation, CN 101514468 (2010).*
Matsushima et al., machine translation, JP S60-165390 (1985).*

*Primary Examiner* — Bryan D. Ripa
*Assistant Examiner* — Ho-Sung Chung
(74) *Attorney, Agent, or Firm* — Birch, Stewart, Kolasch & Birch, LLP

(57) ABSTRACT

An electrical brush plating system and method for metal parts wherein a motion control member and a plating bath with a plating pen includes an anode member provided with an anode plate and bristles that are mounted on the motion control member. A part to be plated is disposed within the plating bath with the bristles provided towards the surface of the part to be plated and under the control of the motion control member, the bristles perform a relative friction motion with the surface of the part to be plated. During the relative friction motion, the surface of the part to be plated is opposite to the anode plate of the anode member. The method includes the steps of mounting the plating pen and the part to be plated; electrocleaning; strong activation;

(Continued)

weak activation and electrical brush plating. The generation of pinholes, pits and nodules are avoided.

8 Claims, 6 Drawing Sheets

(51) Int. Cl.

| | |
|---|---|
| ***C25D 3/12*** | (2006.01) |
| ***C25D 17/12*** | (2006.01) |
| ***C25D 21/12*** | (2006.01) |

(56) References Cited

U.S. PATENT DOCUMENTS

| | | | | | |
|---|---|---|---|---|---|
| 5,200,055 | A * | 4/1993 | Zitko | B01D 47/06 | 204/276 |
| 5,277,785 | A * | 1/1994 | Van Anglen | C25D 5/06 | 205/117 |
| 2004/0140224 | A1* | 7/2004 | Steele | B23H 11/003 | 205/640 |
| 2005/0205425 | A1* | 9/2005 | Palumbo | C25D 1/04 | 204/499 |
| 2006/0049037 | A1* | 3/2006 | Nishino | B24B 19/028 | 204/214 |
| 2006/0049038 | A1* | 3/2006 | Griego | C25D 17/12 | 204/228.1 |
| 2006/0226018 | A1* | 10/2006 | Iwazaki | C25D 5/08 | 205/148 |
| 2008/0029400 | A1* | 2/2008 | Mazur | C25D 5/02 | 205/136 |
| 2013/0001087 | A1* | 1/2013 | Asa | C25D 17/10 | 205/80 |

* cited by examiner

ELECTRICAL BRUSH PLATING SYSTEM AND METHOD FOR METAL PARTS

TECHNICAL FIELD

The present invention relates to an apparatus and method for electrical brush plating surfaces of metal parts and pertains to the field of electrical brush plating.

BACKGROUND ART

Electrical brush plating is a method originally used by electroplating workers to repair defects of bath-plated parts, in which the anode is wrapped with a piece of cotton, dipped in a bath plating solution, and rubbed at defects of parts. While with the development of technology, the electrical brush plating technology has gradually developed into a unique new technology, which is an advanced remanufacturing technology for surface engineering and equipments and has the advantages of high plating speed, various plated layers, high bonding strength, little environmental pollution, saving water and electricity, etc., with more and more fields involved.

At present, more and more industries (for example, remanufacturing industry) have put forward higher requirements for the electrical brush plating technology, however, the existing electrical brush plating technology has many defects and can not meet the requirements put forward by these industries. Defects of the existing electrical brush plating technology are: First, most of the industries complete electrical brush plating operations manually, the degree of automation is low, the working efficiency is not high, the labor intensity of operators is high, and the quality of the plated layers can not be guaranteed; Second, the plating pen (anode) is made by being wrapped with graphite or cotton, this kind of plating pen has poor wear resistance and short service life, and frequent replacement of plating pens between various processes is required, so the quality of the plated layer can not be guaranteed; Third, the metal ions in electrical brush plating solution can not be automatically supplemented, and the plating solution can not be recycled, which is a serious waste of plating solution.

SUMMARY OF THE INVENTION

The object of the present invention is to provide an electrical brush plating system and method for metal parts which can enhance the electrodeposition rate, avoid the generation of pinholes, pits, nodules and other defects in the plated layer, and improve the quality of the plated layer.

To achieve the above objects, the present invention adopts the following technical solutions:

An electrical brush plating system for metal parts, characterized in that: it comprises a motion control means and a plating bath, wherein: a plating pen comprising an anode member provided with an anode plate and bristles thereon is mounted on the motion control means provided on a bracket, a part to be plated is disposed within the plating bath by a workpiece positioning apparatus provided in the plating bath, the bristles provided towards the surface of the part to be plated, under the control of the motion control means, perform a relative friction motion with the surface of the part to be plated, during the relative friction motion, the surface of the part to be plated is opposite to the anode plate of the anode member, the part to be plated is connected to the negative pole of a DC power supply, and the anode plate is connected to the positive pole of the DC power supply.

The motion control means comprises a motor which controls the rotational motion of the plating pen, the motor is connected to a control system and has an output shaft set vertically downward with a clamp provided thereon, a mounting rod provided on top of the plating pen is fixedly disposed in the clamp, so that the plating pen is in a suspended and fixed state.

The plating pen is an plating pen for external cylindrical parts, the part to be plated is an external cylindrical part, the plating pen for external cylindrical parts comprises the anode member which has a hollow cylindrical structure with the lower end opened, the inner wall of the anode member is provided with the anode plate and at least one set of the bristles, each set of the bristles is in a long strip shape, the bristles are oriented towards the surface to be plated of the external cylindrical part disposed within the hollow cavity of the anode member, the bristles on the rotational anode member, under the control of the motor, perform a relative friction motion with the surface to be plated of the external cylindrical part, during the relative friction motion, the surface to be plated of the external cylindrical part is opposite to the anode plate on the inner wall of the anode member.

The plating pen is an plating pen for inner-hole parts, the part to be plated is an inner-hole part, the plating pen for inner-hole parts comprises the anode member which has a cylindrical structure, the outer wall of the anode member is provided with the anode plate and at least one set of the bristles, each set of the bristles is in a long strip shape, the bristles are oriented towards the surface to be plated of the inner-hole part sleeved on the anode member, the bristles on the rotational anode member, under the control of the motor, perform a relative friction motion with the surface to be plated of the inner-hole part, during the relative friction motion, the surface to be plated of the inner-hole part is opposite to the anode plate on the outer wall of the anode member.

The plating pen is an plating pen for planar parts, the part to be plated is an planar part, the plating pen for planar parts comprises the anode member which has a flat-plate structure, the bottom surface of the anode member is provided with the anode plate and at least one set of the bristles, each set of the bristles is in a long strip shape, the bristles are oriented towards the surface to be plated of the planar part disposed under the anode member, the bristles on the rotational anode member, under the control of the motor, perform a relative friction motion with the surface to be plated of the planar part, during the relative friction motion, the surface to be plated of the planar part is opposite to the anode plate on the bottom surface of the anode member.

The motion control means further includes a drive means which controls the reciprocating linear or planar motion of the plating pen for planar parts.

The electrical brush plating system for metal parts comprises a liquid supply and distribution means which comprises a plurality of liquid supply tanks containing different solutions for electrical brush plating, respectively, the output ports of the respective liquid supply tanks are connected to a liquid infusion port of the plating bath through a peristaltic pump, the liquid discharge port of the plating bath is connected to a corresponding return port of the liquid supply tanks though the control of a dispense motor, filter cartridges are installed at the return ports of the respective liquid supply tanks.

The distance between the surface of the part to be plated and the anode plate is between 45 mm and 55 mm, the magnitude of interference of the contact between the bristles and the surface of the part to be plated which perform a relative friction motion is between 2 mm and 3 mm.

An electrical brush plating method for metal parts which is implemented based on the electrical brush plating system for metal parts, characterized in that it comprises the following steps:

Step 1: The plating pen and the part to be plated are installed;

Step 2: Electrocleaning: an electrocleaning solution is poured into the plating bath, the DC power supply and the motion control means are turned on, and the surface of the part to be plated performs a relative friction motion with the bristles, in the electrocleaning process, the cathode current density is between 1 A/dm$^2$ and 100 A/dm$^2$, when the set electrocleaning time is reached, the DC power supply and the motion control means are turned off, the electrocleaning solution is discharged, and then a rinse with clean water is performed for at least two times;

Step 3: Strong activation: a strong activation solution is poured into the plating bath, the DC power supply and the motion control means are turned on, and the surface of the part to be plated performs a relative friction motion with the bristles, in the strong activation process, the cathode current density is between 1 A/dm$^2$ and 200 A/dm$^2$, when the set strong activation time is reached, the DC power supply and the motion control means are turned off, the strong activation solution is discharged, and then a rinse with clean water is performed for at least two times;

Step 4: Weak activation: a weak activation solution is poured into the plating bath, the DC power supply and the motion control means are turned on, and the surface of the part to be plated performs a relative friction motion with the bristles, in the weak activation process, the cathode current density is between 1 A/dm$^2$ and 100 A/dm$^2$, when the set weak activation time is reached, the DC power supply and the motion control means are turn off, the weak activation solution is discharged, and then a rinse with clean water is performed for at least two times;

Step 5: Electrical brush plating: a plating solution is poured into the plating bath, the DC power supply and the motion control means are turned on, and the surface of the part to be plated performs a relative friction motion with the bristles, in the electrical brush plating process, the speed of the relative motion of the bristles with respect to the surface of the part to be plated is controlled between 10 m/min and 20 m/min, the cathode current density is between 10 A/dm$^2$ and 25 A/dm$^2$, when the set electrical brush plating time is reached, the DC power supply and the motion control means are turned off, the plating solution is discharged, and then a resin with clean water is performed for at least two times.

When the anode plate is a soluble nickel plate, the plating solution consists of nickel sulfate, boric acid, nickel chloride and water, wherein the contents of nickel sulfate, boric acid and nickel chloride are 260~300 g/L, 41~50 g/L and 60~80 g/L, respectively.

The advantages of the present invention are:

The system of the present invention improves the liquid phase mass transfer process during the electrical brush plating process, effectively raises the ultimate electrodeposition current density of the plating solution and the upper limit of the current density allowed to be used, enhances the electrodeposition rate, removes the surface impurities, inhibits the penetration of hydrogen into the plated layer, effectively avoids the generation of pinholes, pits, nodules and other defects in the plated layer, and improves the quality of the plated layer.

The method of the invention simplifies the electrical brush plating process. Compared to traditional electrical brush plating technologies, the method of the present invention eliminates the rendering process, which advantageously saves resources and reduces the manufacturing costs.

BEST MODE FOR CARRYING OUT THE INVENTION

Figure 1:
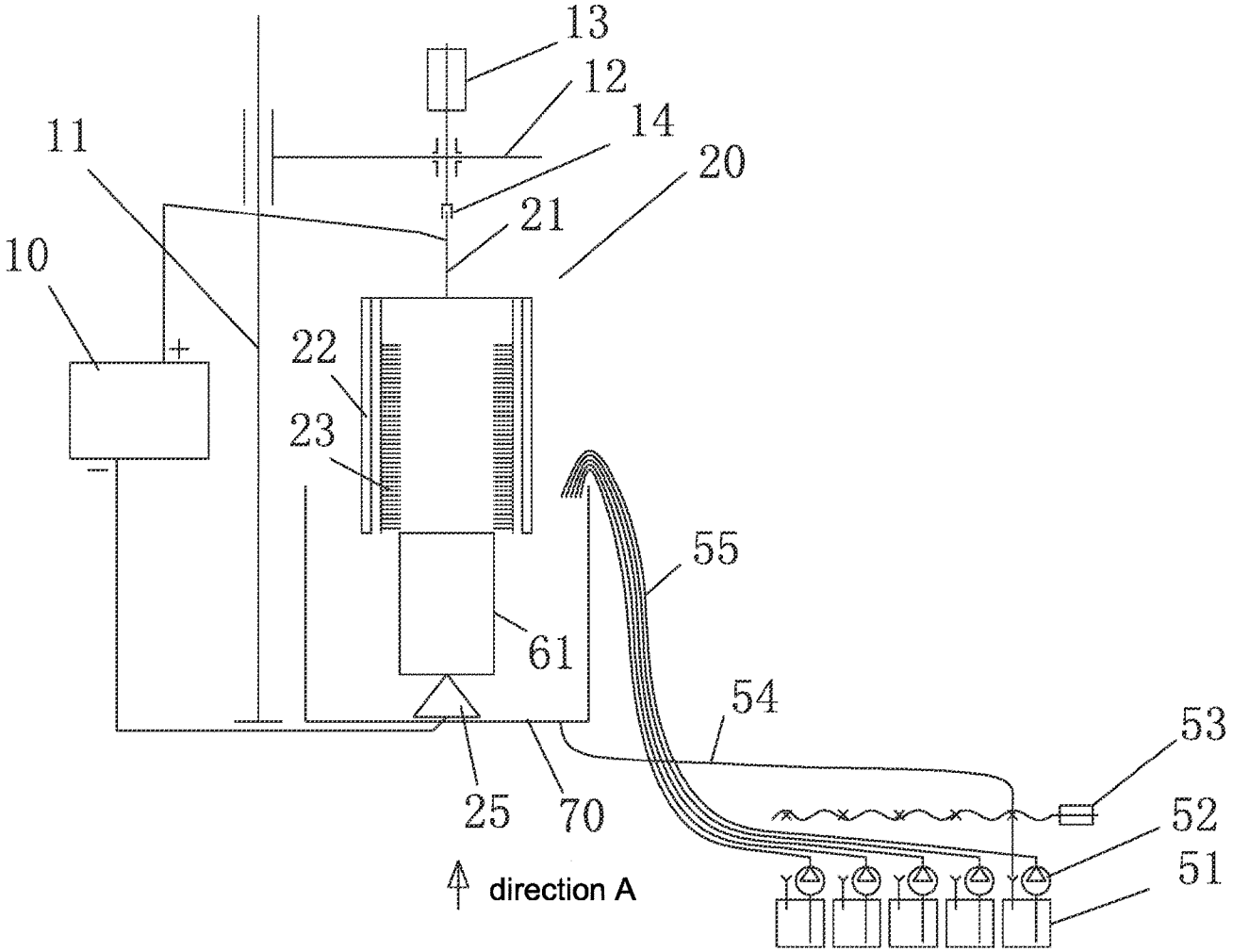
FIG. 1 is a schematic diagram of the composition of the first embodiment of the electrical brush plating system of the present invention.

As shown, the electrical brush plating system for metal parts comprises a motion control means and a plating bath 70, wherein: a plating pen comprising an anode member provided with an anode plate and bristles thereon is mounted on the motion control means provided on a bracket, the bracket may comprise a vertical bracket 11 and a beam 12 that can move vertically up and down on the vertical bracket 11, a part to be plated is disposed within the plating bath by a workpiece positioning apparatus provided in the plating bath 70, the bristles provided towards the surface of the part to be plated, under the control of the motion control means, perform a relative friction motion with the surface of the part to be plated, during the relative friction motion, the surface of the part to be plated is opposite to the anode plate of the anode member, the part to be plated is connected to the negative pole of a DC power supply 10, and the anode plate is connected to the positive pole of the DC power supply 10.

The present invention could perform electrical brush plating operations on various types of metal parts by changing the plating pen, for example, the plating pen for external cylindrical parts could perform electrical brush plating on cylindrical metal parts, the plating pen for inner-hole parts could perform electrical brush plating on inner-hole metal parts, and the plating pen for planar parts could perform electrical brush plating on planar metal parts, wherein: the plating pen for external cylindrical parts and the plating pen for inner-hole parts perform the electrical brush plating in a rotational motion manner, and the plating pen for planar parts could perform the electrical brush plating not only in the rotational motion manner but also in a reciprocating linear or planar motion manner, depending on the requirements of the electrical brush plating.

As shown in FIGS. 1-5, the motion control means may comprise a motor 13 which controls the rotational motion of the plating pen (including a plating pen for external cylindrical parts 20, a plating pen for inner-hole parts 30, and a plating pen for planar parts 40), the motor 13 is connected to a control system (not shown in figures) and has an output shaft set vertically downward with a clamp 14 provided thereon, a mounting rod provided on top of the plating pen is fixedly disposed in the clamp 14, so that the plating pen is in a suspended and fixed state. In addition, the motion control means may further comprise a drive means (not shown in figures) which controls the reciprocating linear or planar motion of the plating pen for planar parts 40.

Figure 2:
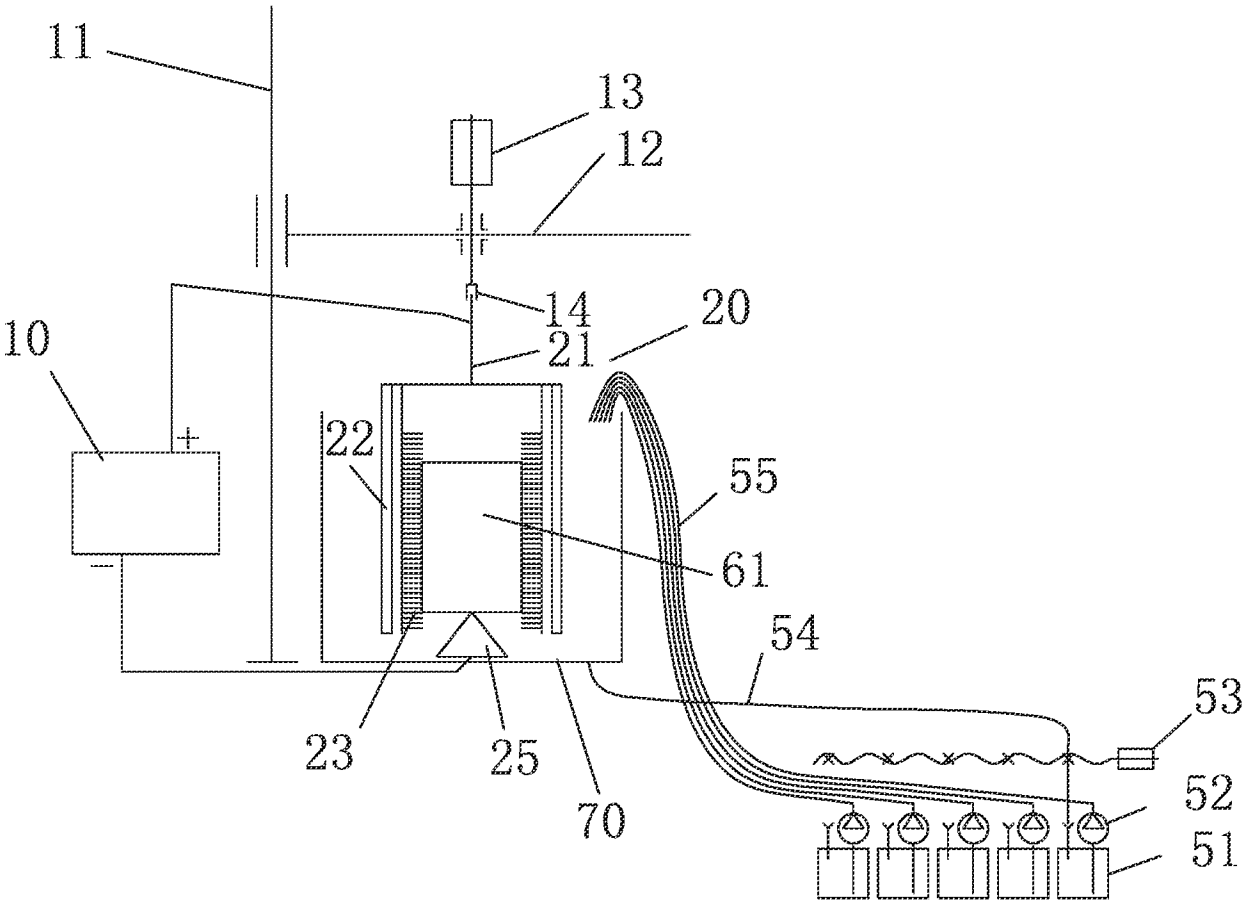
FIG. 2 is a schematic diagram of the operating state of the first embodiment of the electrical brush plating system of the present invention.
Figure 6:
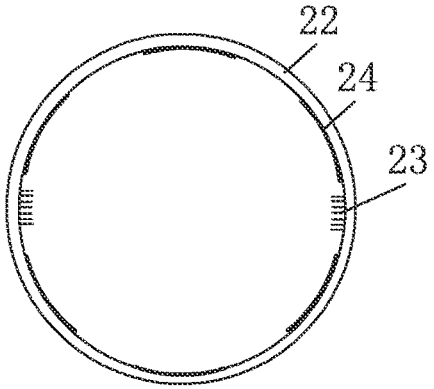
FIG. 6 is a structural schematic diagram of the plating pen viewed from the direction A in FIG. 1.

As shown in FIGS. 1 and 2, when the plating pen is the plating pen for external cylindrical parts 20, the part to be plated is an external cylindrical part 61, which is a metal part such as an engine gudgeon pin and the like. The external cylindrical part 61 is placed in the plating bath 70 by a workpiece positioning pin 25 and is connected to the negative pole of the DC power supply 10. The plating pen for external cylindrical parts 20 is fixedly provided in the clamp 14 through the mounting rod 21 on its top and is in a suspended and fixed state, the plating pen for external cylindrical parts 20 includes an anode member 22 which is made of bakelite materials that are non-conductive and have small deformations, the anode member 22 has a hollow cylindrical structure with the lower end opened, the inner wall of the anode member 22 is provided with an anode plate 24 and at least one set of bristles 23, with each set of bristles 23 being in a long strip shape. As shown in FIG. 6, the anode plate 24 is connected to the positive pole of the DC power supply 10, the bristles 23 are provided towards the surface to be plated of the external cylindrical part 61 (i.e. the outer sidewall of the external cylindrical part 61) which is provided within the hollow cavity of the anode member 22, the bristles 23 on the rotating anode member 22, under the control of the motor 13, perform a relative friction motion with the surface to be plated of the external cylindrical part 61, during the relative friction motion, the surface to be plated of the external cylindrical part 61 is opposite to the anode plate 24 on the inner wall of the anode member 22.

For the plating pen for external cylindrical parts 20, a plurality of anode plates 24 may be uniformly distributed on the inner wall of the hollow cylinder-shaped anode member 22, similarly, multiple sets of bristles 23 may be uniformly distributed on the inner wall of the hollow cylinder-shaped anode member 22. As shown in FIG. 6, six anode plates 24 are uniformly distributed on the inner wall of the anode member 22 shown in the figure, and two sets of bristles 23 are distributed thereon, the two sets of bristles 23 are symmetrically disposed about the central axis of the anode member 22.

Figure 3:
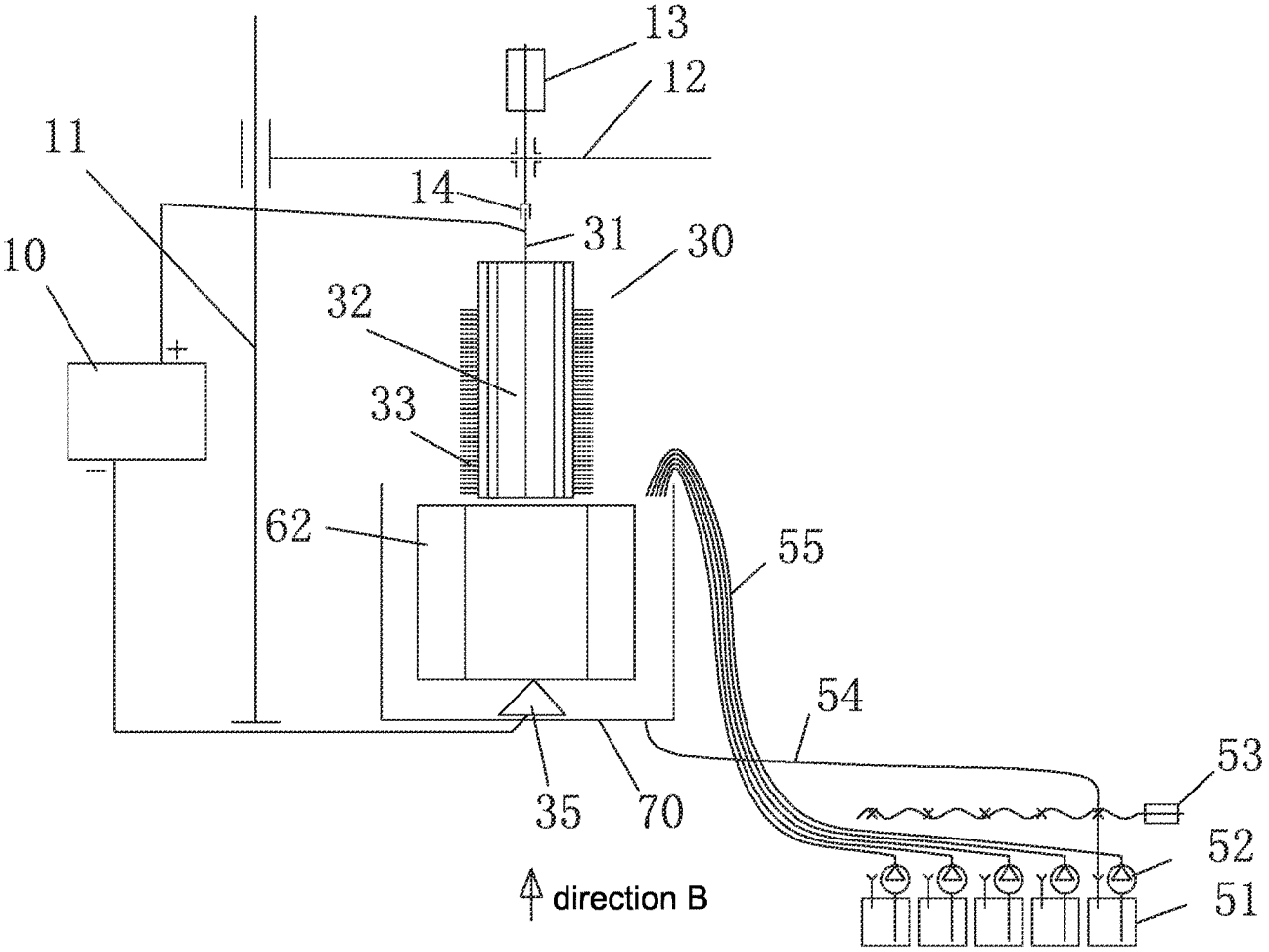
FIG. 3 is a schematic diagram of the composition of the second embodiment of the electrical brush plating system of the present invention.
Figure 4:
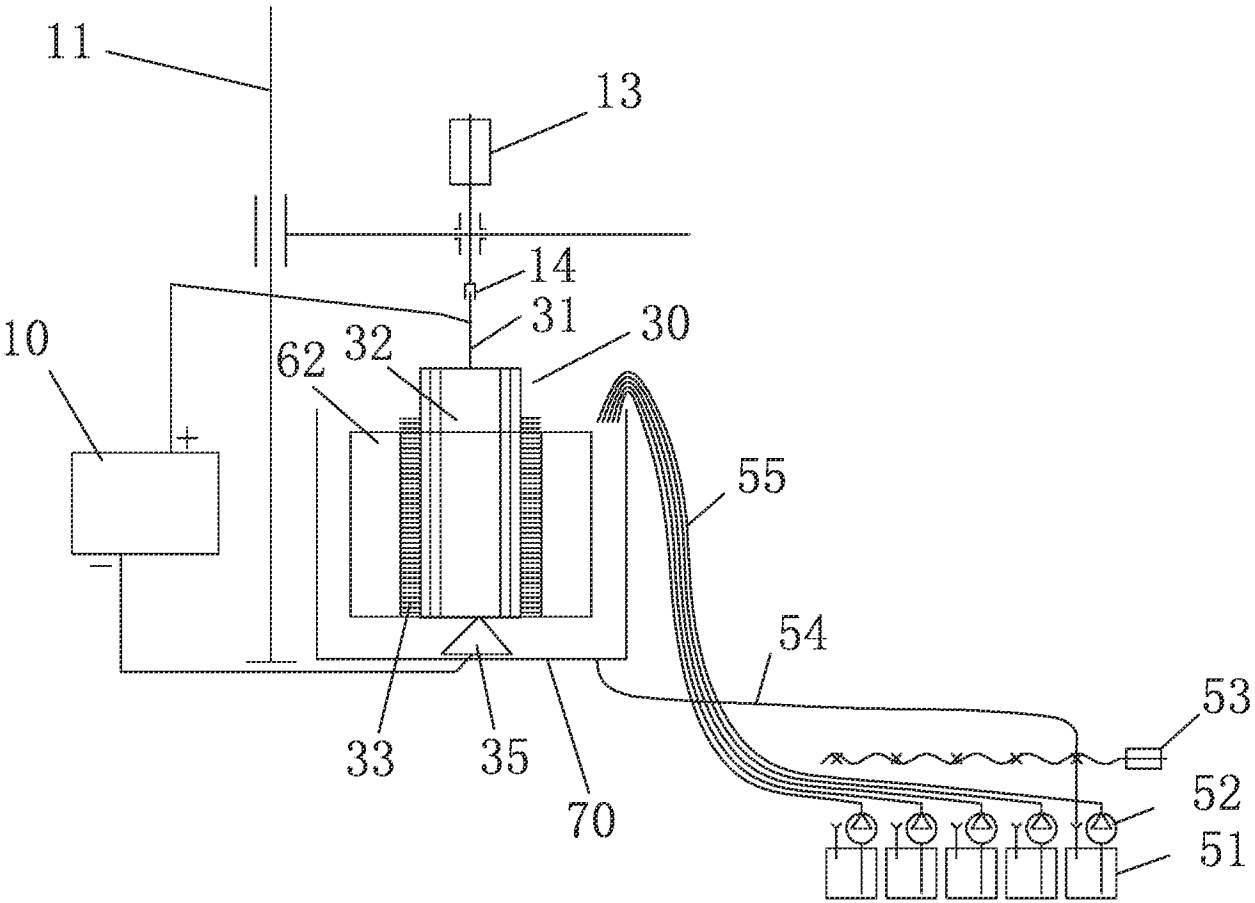
FIG. 4 is a schematic diagram of the operating state of the second embodiment of the electrical brush plating system of the present invention.
Figure 7:
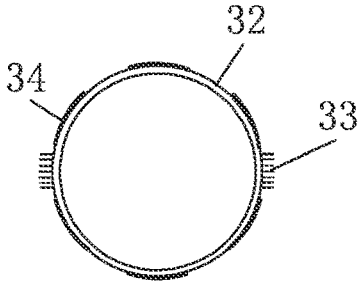
FIG. 7 is a structural schematic diagram of the plating pen viewed from the direction B in FIG. 3.

As shown in FIGS. 3 and 4, when the plating pen is the plating pen for inner-hole parts 30, the part to be plated is an inner-hole part 62, which is a metal part such as an engine connecting-rod big end hole, a cylinder bore and the like. The inner-hole part 62 is placed in the plating bath 70 by the workpiece positioning pin 35 and is connected to the negative pole of the DC power supply 10. The plating pen for inner-hole parts 30 is fixedly provided in the clamp 14 through the mounting rod 31 on its top and is in a suspended and fixed state, the plating pen for inner-hole parts 30 includes an anode member 32 which is made of bakelite materials that are non-conductive and have small deformations, the anode member 32 has a cylindrical structure, the outer wall of the anode member 32 is provided with an anode plate 34 and at least one set of bristles 33, with each set of bristles 33 being in a long strip shape. As shown in FIG. 7, the anode plate 34 is connected to the positive pole of the DC power supply 10, the bristles 33 are oriented towards the surface to be plated of the inner-hole part 62 (i.e. the hole wall of the inner hole of the inner-hole part 62) which is sleeved on the anode member 32, the bristles 33 on the rotating anode member 32, under the control of the motor 13, perform a relative friction motion with the surface to be plated of the inner-hole part 62, during the relative friction motion, the surface to be plated of the inner-hole part 62 is opposite to the anode plate 34 on the outer wall of the anode member 32.

For the plating pen for inner-hole parts 30, a plurality of anode plates 34 may be uniformly distributed on the outer wall of the cylinder-shaped anode member 32, similarly, multiple sets of bristles 33 may be uniformly distributed on the inner wall of the cylinder-shaped anode member 32. As shown in FIG. 7, six anode plates 34 are uniformly distributed on the outer wall of the anode member 32 shown in the figure, and two sets of bristles 33 are distributed thereon, the two sets of bristles 33 are symmetrically disposed about the central axis of the anode member 32.

Figure 5:
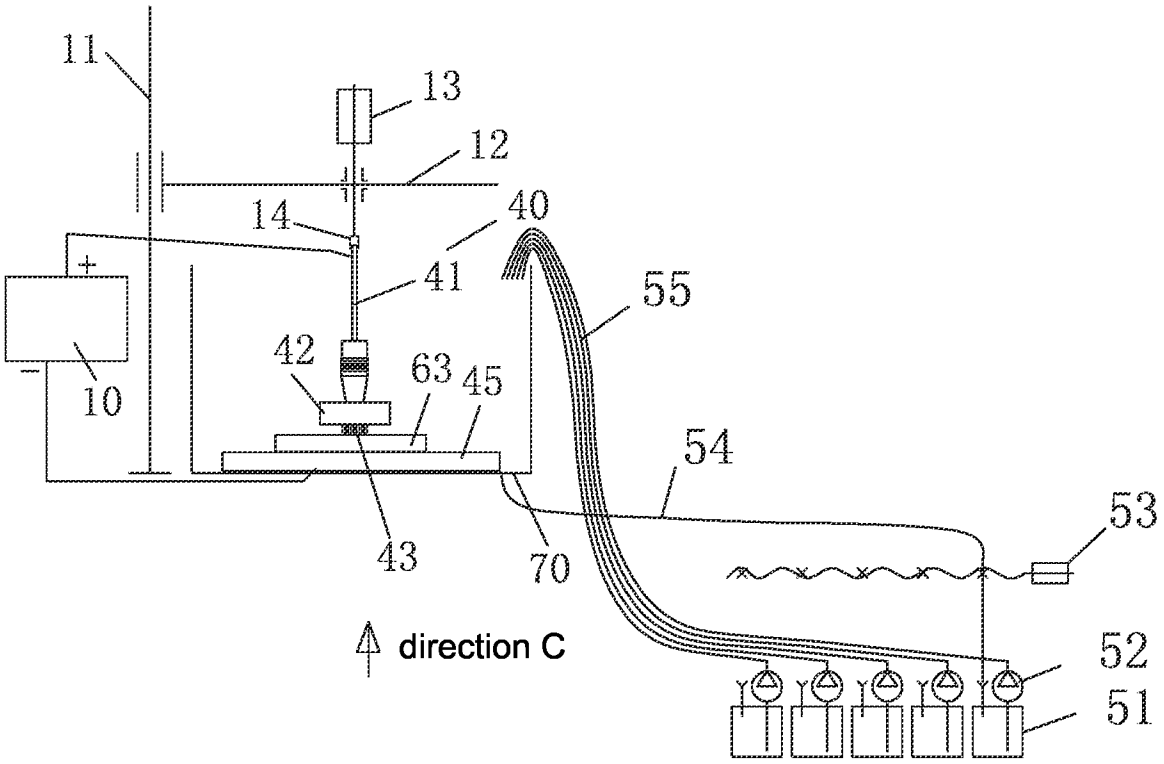
FIG. 5 is a schematic diagram of the composition and the operating state of the third embodiment of the electrical brush plating system of the present invention.
Figure 8:
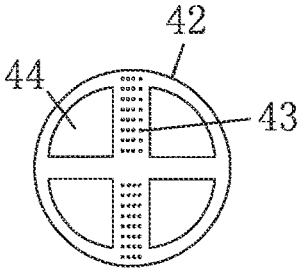
FIG. 8 is a structural schematic diagram of the plating pen viewed from the direction C in FIG. 5.

As shown in FIG. 5, when the plating pen is the plating pen for planar parts 40, the part to be plated is a planar part 63, which is a metal part such as an engine's cylinder head and the like. The planar part 63 is placed in the plating bath 70 by a workpiece positioning plate 45 and is connected to the negative pole of the DC power supply 10. The plating pen for planar parts 40 is fixedly provided in clamp 14 through the mounting rod 41 on its top and is in the suspended and fixed state, the plating pen for planar parts 40 includes an anode member 42 which is made of bakelite materials that are non-conductive and have small deformations, the anode member 42 has a flat-plate structure, the bottom surface of the anode member 42 is provided with an anode plate 44 and at least one set of bristles 43, with each set of bristles 43 being in a long strip shape. As shown in FIG. 8, the anode plate 44 is connected to the positive pole of the DC power supply 10, the bristles 43 are oriented towards the surface to be plated of the planar part 63 (i.e. the upper plane of the planar part 63) which is disposed under the anode member 42, the bristles 43 on the rotational anode member 42, under the control of the motor 13, perform a relative friction motion with the surface to be plated of the planar part 63, during the relative friction motion, the surface to be plated of the planar part 63 is opposite to the anode plate 44 on the bottom surface of the anode member 42. In addition, the anode member 42 can also perform a reciprocating linear or planar motion under the control of the drive means, similarly, the bristles 43 on the anode member 42 which performs a reciprocating linear or planar motion perform a relative friction motion with the surface to be plated of the planar part 63.

For the plating pen for planar parts 40, a plurality of anode plates 44 may be uniformly distributed on the bottom surface of a flat plate-shaped anode member 42, similarly, multiple sets of bristles 43 may be uniformly distributed on the bottom surface of the flat plate-shaped anode member 42. As shown in FIG. 8, four anode plates 44 are uniformly distributed on the bottom surface of the anode member 42 shown in the figure, and two sets of bristles 43 are distributed thereon, the two sets of bristles 43 are symmetrically disposed about the central axis of the anode member 42.

It should be noted that, in actual use, the bristles, the part to be plated and the anode plate are all required to be in the plating solution contained in the plating bath 70. For the various plating pens described above, preferably, it should be ensured that the surface of the part to be plated is always opposite to the anode plate during the entire process of the electrical brush plating, so as to ensure the relative homogeneity of the electrodeposition current density and ensure the electrical brush plating quality of the part to be plated. And preferably, the anode plate should be parallelly opposite to the surface of the part to be plated.

It should be mentioned that a certain part of the surface of the part to be plated does not perform a relative friction motion with the bristles all the time during the entire electrical brush plating process, such a design is made to ensure the normal electrodeposition and ensure that the quality of the surface of the plated layer will not be damaged.

In the actual design, the material of the anode plate is determined based on the type and the material of the layer to be plated on the part to be plated, for example, if a single metal nickel plated layer is to be plated, the anode plate may optionally use a soluble nickel plate. And the ingredients of the plating solution should also be selected based on the type and the nature of the layer to be plated.

In an actual design, preferably, the distance between the surface of the part to be plated and the anode plate should be between 45 mm and 55 mm, such a distance design is beneficial for improving the effect of electrical brush plating and ensuring the quality of electrical brush plating, the magnitude of interference of the contact between the bristles and the surface of the part to be plated which perform a relative friction motion with each other should be between 2 mm and 3 mm, so that the bristles can be closely attached on the surface to be plated to perform the friction motion, which plays a role of mutual friction and disturbance, and the bristles will not adversely affect the surface of the part to be plated. If the magnitude of interference is less than 2 mm, a good mutual friction effect could not be achieved, and if the magnitude of interference is greater than 3 mm, the bristles will have a lifetime easily shortened due to the intensified friction and result in a large area of coverage and shield on the surface to be plated, which will causes the deposition quality and deposition efficiency of the plated layer to decrease.

In the actual design, the bristles may be fixed on a brush handle and may be made of flexible material, which can be made of animal hairs (such as hog hair, horse hair, etc.) or artificial flexible materials (such as PA, PP materials, etc.) or natural fibers (such as *Arenga tremula* Becc, etc.). The set of bristles should have a certain width and thickness, the length is determined depending on the requirements of the electrical brush plating and is generally slightly greater than the length of the surface to be plated, and the bristles are required to be non-conductive and resistant to acid and alkali corrosion and have a certain strength and plasticity and higher abrasion resistance and heat resistance.

In the present invention, the plating bath 70 and the plating pen should be reasonably sized correspondingly according to the actual size of the metal parts plated. Non-conductive, corrosion-resistant polytetrafluoroethylene and like materials can be selected to make the plating bath 70. Also, an apparatus to keep the plating solution at a constant temperature may also be provided within the plating bath 70.

As shown, the present electrical brush plating system for metal parts may also include a liquid supply and distribution means which comprises a plurality of liquid supply tanks 51 which contain different electrical brush plating solutions, respectively, for example, as shown in FIG. 1, five liquid supply tanks 51 are provided, with each of the liquid supply tanks 51 containing clean water, electrocleaning solution, strong activation solution, weak activation solution and the plating solution, respectively. The liquid output port of each of the liquid supply tanks 51 communicates with the liquid infusion port of the plating bath 70 through a peristaltic pump 52 via a transportation pipeline 55, respectively, the liquid discharge port of the plating bath 70 communicates with a return port of a corresponding liquid supply tank 51 through the control of a dispense motor 53 via a discharge pipeline 54, filter cartridges (not shown in the figures) are installed at the return port of each of the liquid supply tanks 51, and the peristaltic pump 52 and the dispense motor 53 are connected to the control system. On one hand, the design of the liquid supply and distribution means can use the various electrical brush plating solutions (clean water, electrocleaning solution, strong activation solution, weak activation solution, the plating solution) by circulation and filtration, which saves a large amount of the various electrical brush plating solutions, on the other hand, the design of the liquid supply and distribution means improves the degree of automation of the electrical brush plating operations, which is beneficial for ensuring stable physical and chemical indexes of the plating solution and the smooth conduction of the electrical brush plating operations.

Based on the present electrical brush plating system for metal parts described above, the present invention further proposes an electrical brush plating method for metal parts, the method includes the following steps:

Step 1: A plating pen and a part to be plated are installed;

Step 2: Electrocleaning: an electrocleaning solution is poured into the plating bath 70, the DC power supply 10 and the motion control means are turned on, and the surface of the part to be plated performs a relative friction motion with the bristles. In the electrocleaning process, the cathode current density is between 1 $A/dm^2$ and 100 $A/dm^2$. When the set electrocleaning time is reached, the DC power supply 10 and the motion control means are turned off, the electrocleaning solution is discharged, and then a rinse with clean water is performed for at least two times;

Step 3: Strong activation: a strong activation solution is poured into the plating bath 70, the DC power supply 10 and the motion control means are turned on, and the surface of the part to be plated performs a relative friction motion with the bristles. In the strong activation process, the cathode current density is between 1 $A/dm^2$ and 200 $A/dm^2$. When the set strong activation time is reached, the DC power supply 10 and the motion control means are turned off, the strong activation solution is discharged, and then a rinse with clean water is performed for at least two times;

Step 4: Weak activation: a weak activation solution is poured into the plating bath 70, the DC power supply 10 and the motion control means are turned on, and the surface of the part to be plated performs a relative friction motion with the bristles. In the weak activation process, the cathode current density is between 1 $A/dm^2$ and 100 $A/dm^2$. When the set weak activation time is reached, the DC power supply 10 and the motion control means are turn off, the weak activation solution is discharged, and then a rinse with clean water is performed for at least two times;

Step 5: Electrical brush plating: a plating solution is poured into the plating bath 70, the DC power supply 10 and the motion control means are turned on, and the surface of the part to be plated performs a relative friction motion with the bristles. In the electrical brush plating process, the speed of the relative motion of the bristles with respect to the surface of the part to be plated is controlled between 10 m/min and 20 m/min, the cathode current density is between 10 $A/dm^2$ and 25 $A/dm^2$, in order to ensure that a faster deposition rate and a plated layer of higher quality are available. When the set electrical brush plating time is reached (the set electrical brush plating time may be determined based on the current density used and the requirement of the thickness of the plated layer), the DC power supply 10 and the motion control means are turned off, the plating solution is discharged, and then a resin with clean water is performed for at least two times.

After that, the plated part is taken out and dried, then a metal part which can meet the required mechanical properties can be obtained.

For the present system shown in FIG. 1, the plating pen for external cylindrical parts 20 is installed. The external cylindrical part 61 is fixed by the workpiece positioning pin 25 and positioned in the hollow cavity within an anode member 22 by vertically moving the beam 12 up and down. The surface to be plated of the external cylindrical part 61 is closely attached to the bristles 23 provided on the anode member 22, and kept opposite to, preferably parallelly opposite to, the anode plate 24 on the inner wall of the anode member 22, as shown in FIG. 2. Then, the electrocleaning operation, strong activation operation, weak activation operation, electrical brush plating operation can be performed in turn, wherein: the plating pen for external cylindrical parts 20 adopts a rotational motion manner.

For the present system shown in FIG. 3, the plating pen for inner-hole parts 30 is installed. The inner-hole part 62 is fixed by the workpiece positioning pin 35 and sleeved outside the anode member 32 by vertically moving the beam 12 up and down. The surface to be plated of the inner-hole part 62 is closely attached to the bristles 33 provided on the anode member 32 and kept opposite to, preferably parallelly opposite to, the anode plate 34 on the outer wall of the anode member 32, as shown in FIG. 4. Then, the electrocleaning operation, strong activation operation, weak activation operation, electrical brush plating operation can be performed in turn, wherein: the plating pen for inner-hole parts 30 adopts a rotational motion manner.

For the present system shown in FIG. 5, the plating pen for planar parts 40 is installed. The planar part 63 is fixed by the workpiece positioning plate 45, and by vertically moving the beam 12 up and down, the anode member 42 is positioned on the planar part 63. The surface to be plated of the planar part 63 is closely attached to the bristles 43 provided on the anode member 42 and kept opposite to, preferably parallelly opposite to, the anode plate 44 on the bottom surface of the anode member 42, as shown in FIG. 5. Then, the electrocleaning operation, strong activation operation, weak activation operation, electrical brush plating operation can be performed in turn, wherein: the plating pen for planar parts 40 may adopt a rotational motion manner or a reciprocating linear or reciprocating planar motion.

In the present method, the electrocleaning solution, strong activation solution, and weak activation solution are well-known solutions, and the electrocleaning operation, strong activation operation, weak activation operation are well-known processing technologies, which will not be described in detail herein.

In the electrical brush plating operation, under the action of the applied current, chemical/electrochemical reactions occur between the part to be plated (cathode) and the plating solution, and the anode plate (anode) and the plating solution, respectively, which causes the metal ions to be electrodeposited on the surface of the part to be plated. The movement of the plating pen in the plating solution and the relative friction motion between the bristles and the part to be plated play a role in stirring the plating solution strongly, which compresses the ion depletion layer (diffusion layer), thereby raising the ultimate electrodeposition current density of the plating solution and the upper limit of the current density allowed to be used, and then accelerating the speed of electrical brush plating. While the relative friction motion between the bristles and the part to be plated may have a friction and disturbance effect on the plated layer formed on the plated part, which can effectively remove the impurities and hydrogen bubbles adsorbed on the plated layer during the electrodepostion process, thus avoiding the generation of pinholes, pits, nodules and other phenomena in the plated layer. Moreover, the relative friction motion between the bristles and the part to be plated can refine the size of the grain, improve the growth rate of each crystal face of the plated layer, inhibit the growth of dendrite, promote the increased growth trend of crystal parallel to the matrixes, make the organization structure of the plated layer become smooth and dense, thus improving the quality and mechanical properties of the plated layer.

In the present invention, when a soluble nickel plate is optionally used as the anode plate, the following formula may be adopted for the plating solution: the plating solution is composed of nickel sulfate, boric acid, nickel chloride and water, wherein the contents of nickel sulfate, boric acid and nickel chloride are 260~300 g/L, 41~50 g/L and 60~80 g/L, respectively.

In the plating solution, nickel sulfate is main salt and acts as a $Ni^{2+}$ provider. Boric acid is a buffer agent and functions as a stabilizer of pH value of the plating solution. The chloride ions in nickel chloride are an anode activator, which plays the role of preventing the anode from being passivated, promoting anodic dissolution, and ensuring proper supplement of nickel ions in the plating solution. If the content of the chloride ions in the plating solution is too low, the anode would be easily passivated, resulting in a decreased content of nickel ions in the plating solution, if the content of the chloride ions is too high, the anode would be over-etched, which tends to result in burrs in the plated layer and may also increase the internal stress of the plated layer, thus affecting quality of the plated layer. Numerous studies have shown that, when cathode/anode ratio is 1:1, it is preferred that the content of nickel chloride in the plating solution is 40~50 g/L. However, when the present electrical brush plating system is used to perform electrical brush plating on metal parts, the cathode/anode area ratio is often too large, which is generally 2:1~5:1, so there is a need to determine the added amount of nickel chloride in the plating solution according to the ratio value of the matrixes. The researches conclude that, when the cathode/anode area ratio is 2:1, the content of nickel chloride is preferably 60 g/L; when the cathode/anode area ratio is 3:1, the content of nickel chloride is preferably 60~70 g/L; when the cathode/anode area ratio is greater than 4:1, the content of nickel chloride is preferably 70~80 g/L.

In order to make full use of the metal ions in the plating solution, the present invention employs a soluble nickel plate (nickel anode), and uses the bristles to rub the surface of the plated layer, the plating pen is soaked in the plating solution to perform the electrical brush plating, the bristles have a friction stir effect on the surface of the plated layer, which may act as a leveling agent, a wetting agent and a brightening agent, thus a bright and smooth plated layer can be obtained without any additives such as leveling agents, wetting agents and brightening agents contained in the plating solution.

On account of the relatively serious problem of hydrogen evolution from the cathode when a higher current density (greater than 12 $A/dm^2$) is employed to perform automatic electrical brush plating of nickel, the present plating solution contains a higher content of boric acid as a buffer agent. The higher content of boric acid can retain pH value of the plating solution within a normal range of process, which may ensure a higher rate of electrodeposition, thus the repair and reproduction time for the parts can be shortened and the production efficiency can be improved.

The plating solution will be further described below with reference to the embodiments.

Embodiment 1

The formula used for the plating solution is: nickel sulfate 280 g/L, boric acid 43 g/L, and nickel chloride 80 g/L. Under the process conditions that the current density is 14 A/dm$^2$, the cathode/anode area ratio is about 2:1, and the plating solution temperature is 50° C., a connecting-rod automatic electrical brush plating is performed and compared with the traditional manual electrical brush plating. The comparison is shown in Table 1.

TABLE 1 the comparison between automatic electrical brush plating and manual electrical brush plating

| Plating pen | Efficiency of electrical brush plating (number per day) | Plating solution consumed (liter per one) | Lifetime of plating pen (number per one) | Production yield | Overall cost of electrical brush plating (Yuan) |
|---|---|---|---|---|---|
| Manual electrical brush plating | 5 | 1.0 | 1 | 60% | 75 |
| Automatic electrical brush plating | 60 | 0.07 | 300 | 95% | 15 |
| Comparison | Increased by above 10 times | Reduced by 93% | Increased by 300 times | Increased by 35% | Reduced by 80% |

In combination with the data in Table 1, it can be seen that the use of this plating solution for automatic electrical brush plating is more efficient than the traditional manual electrical brush plating, and the plating solution needs no additives to be added in during use. After a long time of use, it is analyzed that the content of nickel ions in the plating solution is essentially unchanged and the plating solution may be recycled for a long time.

The automatic electrical brush plating nickel-plated layer prepared by this plating solution has a smooth and bright surface, and the surface roughness is reduced to less than 0.4 μm, compared with 3~5 μm of the manual electrical brush plating. After subjected to thermal shock, eccentric wear and other tests, there is no peeling, shedding and other phenomenon occurred in the plated layer. At the same time, when a high resolution transmission electron microscopy is used to observe the plated layer/matrixes junction parts, it is found that the binding of plating/matrixes is an atombic binding, thus the plated layer has a very high bonding strength.

Embodiment 2

The formula used for the plating solution is: nickel sulfate 300 g/L, boric acid 45 g/L, and nickel chloride 60 g/L. Under the process conditions that the current density is 16 A/dm$^2$, the cathode/anode area ratio is about 4:1, and the plating solution temperature is 50° C., an automatic electrical brush plating for reproduction (repair) is performed on a waste engine block. The average time spent in reproducing a block is 2.5 h, and metal consumption is 200~300 g, electricity consumption is 8.5 KW, and the overall reproduction cost for each block is 450 yuan (as will be detailed with reference to Table 2), this not only solves the difficulty that cylinder parts can not be reproduced, but also creates huge economic and social benefits.

TABLE 2 the comparison between Steyr engine block reproduction with the device and a new engine block production

| Comparison items | New engine block production | Old engine block reproduction | Comparison | Remarks |
|---|---|---|---|---|
| Material consumption (kilogram) | 350 (billet weight) | 0.3 | Saved 99.9% | Since only the size of the surface of the engine block bore needs to be recovered, the material consumption is significantly reduced. |
| Manufacturing process (number of process steps) | 24 | 5 | Reduced 19 process steps | The production of a new engine block needs 24 process steps in all, including casting, complex machining, detecting and other process steps; while the reproduction of an old engine block needs only 5 process steps, which are dismantling, cleaning, electrical brush plating, machining and detecting. |

TABLE 2-continued

| the comparison between Steyr engine block reproduction with the device and a new engine block production | | | | |
|---|---|---|---|---|
| Comparison items | New engine block production | Old engine block reproduction | Comparison | Remarks |
| yield | 97% | 100% | Increased by 3% | Due to casting defects, such as sand hole and the like, the new engine block production has a certain scrappage rate; while the engine blocks selected for reproduction are qualified through practical tests, and the yield can reach 100%. |
| Production cost (Yuan) | 4500 | 450 | Reduced by 90% | Due to the materials greatly saved and the number of process steps significantly reduced, the production cost is also greatly reduced. |
| Selling price (Yuan) | 9000 | 4500 | Reduced by 50% | Under the premise that the reproduced products share the same quality assurance with new products, the selling price of the reproduced products is only 50% of that of new products. |
| Margin | 100% | 999% | Increased by 10 times | Although the selling price is reduced by a half, margin is still increased by 10 times due to the significant reduction of production cost. |

Comparing with the production of new Steyr engine block, for reproduction of waste engine block adopting this plating solution, material consumption and manufacturing process is greatly reduced, yield is increased by 3%, production cost is reduced by 90%, margin is increased by 10 times.

Meanwhile, the block after reproduction adopting this plating solution has a smooth and bright surface, and the surface roughness is less than 0.4 μm. After subjected to thermal shock, eccentric wear and other tests, there is no peeling, shedding and other phenomenon occurred in the plated layer. At the same time, when a high resolution transmission electron microscopy is used to observe the plated layer/matrixes junction parts, it is found that the binding of plating/matrixes is an atomic binding, thus the plated layer has a very high bonding strength.

In the present method, the chemical/electrochemical reaction occurred between the part to be plated and the plating solution, and the chemical/electrochemical reactions occurred between the anode plate and the plating solution are well known in the art, which will not be described in detail herein.

The present invention has the following advantages:

1. By changing the plating pen, the present invention could perform electrical brush plating operation on various type of metal parts, for example, the plating pen for external cylindrical parts could perform electrical brush plating on cylindrical metal parts, the plating pen for inner-hole parts could perform electrical brush plating on inner-hole metal parts, the plating pen for planar parts could perform electrical brush plating on planar metal parts, wherein: the plating pen for external cylindrical parts and the plating pen for inner-hole parts perform the electrical brush plating in a rotational motion manner, while the plating pen for planar parts could perform the electrical brush plating not only in the rotational motion manner but also in a reciprocating linear or planar motion manner, depending on the requirements of the electrical brush plating. Also, the present invention is applicable to perform electrical brush plating on various types of metal parts to obtain various plated layers, such as single metal (for example, nickel, copper, zinc and the like) plated layers, alloy (for example, Ni—Co, Cu—Zn, Zn—Ni and the like) plated layers, nano-composite plated layers and the like.

2. By the relative friction motion between the bristles and the part to be plated, the present invention improves the liquid phase mass transfer process, effectively raises the ultimate electrodeposition current density of the plating solution and the upper limit of the current density allowed to be used, enhances the electrodeposition rate, removes the surface impurities, inhibits the penetration of hydrogen into the plated layer, effectively avoids the generation of pinholes, pits, nodules and other defects in the plated layer, and improves the quality of the plated layer.

3. The present system effectively reduces the labor intensity of the workers, enhances the stability of the electrical brush plating. The present invention is applicable not only to strengthen new workpieces, but also to repair and reproduce the workpieces that subjected to wear, corrosion, deformation.

4. By the liquid supply and distribution means of the present invention, clean water, electrocleaning solution, strong activation solution, weak activation solution, and plating solution can be used by circulation and filtration, which saves a large amount of the various electrical brush plating solutions. In addition, the distribution means is beneficial for ensuring stable physical and chemical indexes of the plating solution and the smooth conduction of the electrical brush plating operations.

5. The anode employed in the present system is a soluble anode, which is easy to clean and has a long lifetime, and thus may be used all the time in multiple process steps of electrical brush plating.

6. The method of the invention simplifies the electrical brush plating process. Compared to the traditional electrical brush plating technologies, the method of the present invention eliminates the rendering process, which advantageously saves resources and reduces the manufacturing costs.

7. When a nickel plate is optionally used as an anode plate, the present invention employs an improved plating solution that has the following advantages: the plating solution has a simple composition, and needs no additives to be added in during use, so it is stable and reliable, easy to maintain, and the waste water of the plating solution is easy to deal with; the plating solution has a wide range of suitable temperatures, and has a strong ability of anti-impurity contamination, the obtained plated layer by use of this plating solution has a good appearance and a low surface roughness, and the bonding strength is high; the plating solution can be applicable to a current density as high as possible in the premise that the obtaining of a plated layer which has an excellent performance is guaranteed, which enhances the deposition rate and shortens the repair and reproduction time; the content of nickel ions in the plating solution may be maintained within the range of process for a long time, thus the plating solution can be recycled and the cost can be reduced.

8. In the present invention, the temperature of the plating solution may also be controlled so as to ensure a higher quality of electrical brush plating results. Also, the open plating bath design of the present invention is helpful to avoid an excessively fast temperature rise of the plating solution caused by the heat dissipation produced by the relative friction motion.

9. The present invention has a high degree of automation, so that it effectively reduces the labor intensity of the workers and production cost, and ensures the stability of the plating quality. Furthermore, the electrical brush plating operation conducted according to the present invention would not affect the purity of the plated layer, and would not change the brittleness of the plated layer, thus the plated layer and matrixes of the part to be plated can maintain a good adhesion with each other.

The above described are preferred embodiments of the present invention and the technical principles thereof, it will be apparent to those skilled in the art that any equivalent variations, simple substitutions or other obvious changes made based on the technology of the present invention are intended to be included within the scope of the invention, without departing from the spirit and scope of the present invention.

The invention claimed is:

1. An electrical brush plating system for metal parts, comprising:

a motion control means;

a plating bath;

a DC power supply;

a plating pen mounted on the motion control means, and containing a rotational anode member having a hollow cavity provided with an anode plate with associated bristles, the anode member being made of bakelite materials that are non-conductive;

a part to be plated positioned in the plating bath by a positioning apparatus provided in the plating bath;

said bristles extending toward the surface of the part to be plated and adapted to perform a frictional motion with the surface of the part to be plated by the motion control means; wherein during the frictional motion, the surface of the part to be plated is positioned opposite to the anode plate of the anode member, wherein a certain section of the surface of the part to be plated does not perform a relative frictional motion with the bristles at all times during the entire electrical brush plating process;

the part to be plated is connected to the negative pole of the DC power supply; and the anode plate is connected to the positive pole of the DC power supply;

the plating pen is adapted for external cylindrical parts, said plating pen comprising the anode member having a hollow cylindrical structure with a lower open end, an inner wall of the anode member being provided with the anode plate containing at least one set of the bristles having a long strip shape, the bristles being oriented towards the surface to be plated of the external cylindrical part disposed within the hollow cavity of the anode member, the bristles on the rotational anode member, being under the control of the motion control means for performing the frictional motion with the surface of the external cylindrical part to be plated, the surface to be plated being positioned opposite to the anode plate on the inner wall of the anode member, wherein the distance between the surface of the part to be plated and the anode member is between 45 mm and 55 mm and a magnitude of interference of the contact between the bristles and the surface of the part to be plated, which performs a relative frictional motion with each other, is between 2 mm and 3mm.

2. The electrical brush plating system for metal parts as recited in claim 1, wherein the motion control means comprises a motor which controls the rotational motion of the plating pen, the motor containing an output shaft extending vertically downward and provided with a clamp, and a mounting rod provided on top of the plating pen is fixedly disposed in the clamp, so that the plating pen is in a suspended and fixed state.

3. The electrical brush plating system for metal parts as recited in claim 1, which further comprises a liquid supply and distribution means which includes a plurality of liquid supply tanks containing different solutions for electrical brush plating, the output ports of the respective liquid supply tanks are connected to a liquid infusion port of the plating bath through a peristaltic pump, a liquid discharge port of the plating bath being connected to a corresponding return port of the liquid supply tanks through the control of a dispense motor, wherein filter cartridges are installed at the return ports of the respective liquid supply tanks.

4. An electrical brush plating method for metal parts which implements the electrical brush plating system for metal parts as claimed in claim 1, the electrical brush plating method comprising the following steps:

step 1: the plating pen and the part to be plated are installed;

step 2: electrocleaning: an electrocleaning solution is poured into the plating bath, the DC power supply and the motion control means are turned on, and the surface of the part to be plated performs a relative frictional motion with the bristles, in the electrocleaning process, the cathode current density is between 1 $A/dm^2$ and 100 $A/dm^2$, when a set electrocleaning time is reached, the DC power supply and the motion control means are turned off, the electrocleaning solution is discharged, and then a rinse with clean water is performed for at least two times;

step 3: strong activation: a strong activation solution is poured into the plating bath, the DC power supply and the motion control means are turned on, and the surface of the part to be plated performs a relative frictional motion with the bristles, in the strong activation process, the cathode current density is between 1 $A/dm^2$ and 200 $A/dm^2$, when a set strong activation time is reached, the DC power supply and the motion control means are turned off, the strong activation solution is discharged, and then a rinse with clean water is performed for at least two times;

step 4: weak activation: a weak activation solution is poured into the plating bath, the DC power supply and the motion control means are turned on, and the surface of the part to be plated performs a relative frictional motion with the bristles, in the weak activation process, the cathode current density is between 1 $A/dm^2$ and 100 $A/dm^2$, when a set weak activation time is reached, the DC power supply and the motion control means are turn off, the weak activation solution is discharged, and then a rinse with clean water is performed for at least two times;

step 5: electrical brush plating: a plating solution is poured into the plating bath, the DC power supply and the motion control means are turned on, and the surface of the part to be plated performs a relative frictional motion with the bristles, in the electrical brush plating process, the speed of the relative motion of the bristles with respect to the surface of the part to be plated is controlled between 10 m/min and 20 m/min, the cathode current density is between 10 $A/dm^2$ and 25 $A/dm^2$, when a set electrical brush plating time is reached, the DC power supply and the motion control means are turned off, the plating solution is discharged, and then a resin with clean water is performed for at least two times.

5. The electrical brush plating method for metal parts as claimed in claim 4, wherein:

when the anode plate is a soluble nickel plate, the plating solution consists of nickel sulfate, boric acid, nickel chloride and water, wherein the contents of nickel sulfate, boric acid and nickel chloride are 260-300g/L, 41-50g/L and 60-80g/L, respectively.

6. The electrical brush plating system for metal parts as recited in claim 2, wherein the electrical brush plating system for metal parts comprises a liquid supply and distribution means which includes a plurality of liquid supply tanks containing different solutions for electrical brush plating, respectively, output ports of the respective liquid supply tanks are connected to a liquid infusion port of the plating bath through a peristaltic pump, a liquid discharge port of the plating bath is connected to a corresponding return port of the liquid supply tanks through the control of a dispense motor, filter cartridges are installed at the return ports of the respective liquid supply tanks.

7. An electrical brush plating system for the external plating of metal parts which comprises:

a plating bath for housing a plating substance, a positioning apparatus disposed in the plating bath for positioning a part to be plated within the plating bath, a plating pen having a configuration which is adapted to surround the external surface of the part to be plated, said plating pen functioning as an anode member having a hollow cavity provided with an anode plate and facilitating a frictional effect by being provided with bristles which extend toward the surface of the part to be plated for frictional engagement therewith, the anode member being made of bakelite materials that are non-conductive, a motion control means operatively connected to the plating pen to position and rotate the plating pen relative to the part to be plated, wherein the bristles of the plating pen are adapted to not perform a relative friction motion with the bristles all the time during the entire electrical brush plating process on a certain section of the surface of the part to be plated by the motion control means, and a DC power supply having a positive pole connected to the anode member and a negative pole communicating with the part to be plated, wherein the distance between the surface of the part to be plated and the anode plate is between 45 mm and 55 mm, and a magnitude of interference of the contact between the bristles and the surface of the part to be plated, which perform a relative frictional motion with each other, is between 2 mm and 3 mm.

8. The electrical brush plating system for the external plating of metal parts as claimed in claim 7, wherein the motion control means comprises a motor which controls the rotational motion of the plating pen, the motor being connected to a control system and provided with an output shaft disposed vertically downward, with a clamp provided thereon, and a mounting rod is connected to the top of the plating pen and is fixedly controlled by the clamp, so that the plating pen is positioned in a suspended state.

* * * * *